US006746287B2

(12) United States Patent
Yamamoto et al.

(10) Patent No.: US 6,746,287 B2
(45) Date of Patent: Jun. 8, 2004

(54) UNDERWATER PROPELLING APPARATUS WHICH STABLY CARRIES OUT A PROPELLING OPERATION AND A STEERING OPERATION

(75) Inventors: Ikuo Yamamoto, Nagasaki-ken (JP); Yuuzi Terada, Hyogo-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/231,091

(22) Filed: Aug. 30, 2002

(65) Prior Publication Data

US 2004/0043677 A1 Mar. 4, 2004

(51) Int. Cl.[7] ..... B63H 1/36
(52) U.S. Cl. ..... 440/15; 114/333; 114/337
(58) Field of Search ..... 114/337, 333; 440/13–15

(56) References Cited

U.S. PATENT DOCUMENTS 35,451 A * 6/1862 Johnson ..... 416/81
6,089,178 A * 7/2000 Yamamoto et al. ..... 114/337

FOREIGN PATENT DOCUMENTS

| | | | |
|---|---|---|---|
| JP | 56-86890 | * | 7/1981 |
| JP | 11-152085 | | 6/1999 |
| JP | 11-321786 | * | 11/1999 |
| JP | 2002-137791 | * | 5/2002 |

* cited by examiner

*Primary Examiner*—Sherman Basinger
(74) *Attorney, Agent, or Firm*—Wenderoth, Lind & Ponack, L.L.P.

(57) ABSTRACT

An underwater propelling apparatus includes a body and a plurality of vibrating units. The plurality of vibrating units are placed in parallel to each other on a rear side of the body. Each of the plurality of vibrating units vibrates repeatedly and reciprocally to produce thrust.

15 Claims, 7 Drawing Sheets

UNDERWATER PROPELLING APPARATUS WHICH STABLY CARRIES OUT A PROPELLING OPERATION AND A STEERING OPERATION

BACKGROUND OF THE INVENTION

1. Field of the Invention

The present invention relates to an underwater propelling apparatus. More particularly, the present invention relates to an underwater propelling apparatus used for a fishing boat, a working boat, a submarine searching boat and a submarine working boat and the like.

2. Description of the Related Art

As a conventional underwater propelling apparatus, a screw propeller 51 is used for a submarine searching boat 52, as shown in FIG. 1.

The screw propeller 51 generates a thrust only in its rotation axis direction. Thus, the directional control of the submarine searching boat 52 requires an auxiliary apparatus such as a rudder 53, a side thruster 54 and the like. Hence, the performances of the directional control and a position keeping control are limited as compared with a straight propelling performance.

Also, there may be a fear that the screw propeller 51 or the side thruster 54 catches nearby matter. Thus, a limit on usage is imposed from the viewpoint of safety.

In the case of a conventional screw propelling apparatus of a submarine searching boat, mud on the sea bottom is disturbed, making noise and disturbing the searching operation. Also, its small energy prevents long operation.

An underwater propelling apparatus is desirable for stably carrying out a propelling operation and a steering operation.

An underwater propelling apparatus is also desired for stably carrying out directional control and position keeping control.

An underwater propelling apparatus is also desired for effectively obtaining thrust.

An underwater propelling apparatus is further desired for freely carrying out not only a propelling operation, but also a steering operation.

An underwater propelling apparatus is also desired for freely carrying out directional control and position keeping control.

An underwater propelling apparatus is further desired which has an excellent silence property.

By the way, Japanese Laid Open Patent Application (JP-A-Heisei, 11-152085), in relation to the application of this applicant, discloses the following underwater running body. That is, in an underwater running body, a plurality of wings, which are vibrated by reciprocating rotations of rotation shafts fixed to a front edge, are installed in series. Then, joint control of respective rotation shafts enables the plurality of wings to be flexibly actuated like a tail fin of a fish as a whole. Thus, thrust can be obtained. In addition, a steering operation can be done by controlling a vibration center of each of the wings. Also, floating/sinking control is carried out by a water filling/draining operation for a tank.

SUMMARY OF THE INVENTION

The present invention is accomplished in view of the above mentioned problems. Therefore, an object of the present invention is to provide an underwater propelling apparatus for stably carrying out a propelling operation and a steering operation.

Another object of the present invention is to provide an underwater propelling apparatus for stably carrying out directional control and position keeping control.

Still another object of the present invention is to provide an underwater propelling apparatus for effectively obtaining thrust.

Still another object of the present invention is to provide an underwater propelling apparatus for freely carrying out not only a propelling operation but also a steering operation.

Still another object of the present invention is to provide an underwater propelling apparatus for freely carrying out directional control and position keeping control.

Still another object of the present invention is to provide an underwater propelling apparatus having an excellent silence property.

In order to achieve the objects of the present invention, an underwater propelling apparatus includes a body and a plurality of vibrating units, which are placed in parallel to each other on a rear side of the body. Each of the plurality of vibrating units vibrates repeatedly and reciprocally to produce thrust. The underwater propelling apparatus of the present invention uses a technique for controlling an elastically vibrating wing. The underwater propelling apparatus of the present invention is a submarine boat (a non-towed underwater vehicle) itself.

In this case, each of the plurality of vibrating units includes a plurality of vibrators which are placed in series and can be controlled independently of each other.

Each of the plurality of vibrators placed in series is elastic, and one vibrator positioned on a rear side from the body of the plurality of vibrators placed in series has a higher elastic modulus than that of another vibrator.

The underwater propelling apparatus is used in a propelled body that is propelled by the underwater propelling apparatus. The plurality of vibrating units are placed at locations separated from each other on a virtual line substantially orthogonal to a direction in which the propelled body is propelled.

The underwater propelling apparatus further includes a tank into and from which water can be filled and drained to control a floating/sinking state of the body and a water filling/draining control unit which controls operations of filling and draining the water into and from the tank.

The body also includes a plurality of underwater running units and a bed unit through which the plurality of underwater running units are linked to each other. The plurality of vibrating units are provided in a plurality of rear portions of the plurality of underwater running units, respectively. Each of the plurality of underwater running units and the bed unit has an outer appearance formed by a smooth curve to reduce underwater resistance.

In this case, each of the plurality of underwater running units is substantially ellipsoidal in shape such that a vertical side of each of the plurality of underwater running units is longer when being viewed from a front of each of the plurality of underwater running units and such that a horizontal side of each of the plurality of underwater running units is longer when viewed from a side of each of the plurality of underwater running units and on a flat plane of each of the plurality of underwater running units.

Also in this case, the bed unit is substantially ellipsoidal in shape such that a horizontal side of the bed unit is longer when being viewed from a side of the bed unit and the bed unit is substantially rectangular in shape such that a horizontal side of the bed unit is longer when viewed from a front of the bed unit and on a flat plane of the bed unit.

Further in this case, the underwater propelling apparatus is an submarine boat, and the plurality of underwater running units are designed such that a separation distance between the plurality of underwater running units is longer than a width dimension of a rear portion of the submarine boat.

In order to achieve another object of the present invention, an underwater propelling apparatus includes a body, a first vibrating unit placed on a rear side of the body in which a first vibrator vibrated by reciprocating rotation of a first rotation shaft and a second vibrator vibrated by reciprocating rotation of a second rotation shaft are arranged in series and a second vibrating unit that is placed on the rear side of the body and placed in parallel to the first vibrating unit in a horizontal direction, in which a third vibrator vibrated by reciprocating rotation of a third rotation shaft and a fourth vibrator vibrated by reciprocating rotation of a fourth rotation shaft are arranged in series. First to fourth actuators rotates the first to fourth rotation shafts, respectively. A vibrator command generator outputs a control signal to set respective amplitudes, frequencies and vibration centers of the first to fourth vibrators associated with the reciprocating rotations of the first to fourth rotation shafts and phases between the first to fourth vibrators to control the first to fourth rotation shafts jointly and respectively. An angular servo driver generates signals to control the first to fourth actuators, respectively, on the basis of the control signal.

In this case, each of the first to fourth vibrators is elastic, and the second vibrator, positioned on the rear side of the body from the first vibrators and arranged in series, has a higher elastic modulus than that of the first vibrator. The fourth vibrator is positioned on the rear side of the body from the third vibrators, is arranged in series and has a higher elastic modulus than that of the third vibrator.

The first to fourth rotation shafts are placed in a horizontal direction.

The first to fourth rotation shafts are placed in a horizontal direction such that it is possible to change a submarine depth of the underwater propelling apparatus.

DESCRIPTION OF THE PREFERRED EMBODIMENTS

An embodiment of an underwater propelling apparatus of the present invention will be described below with reference to the attached drawings.

Figure 1:
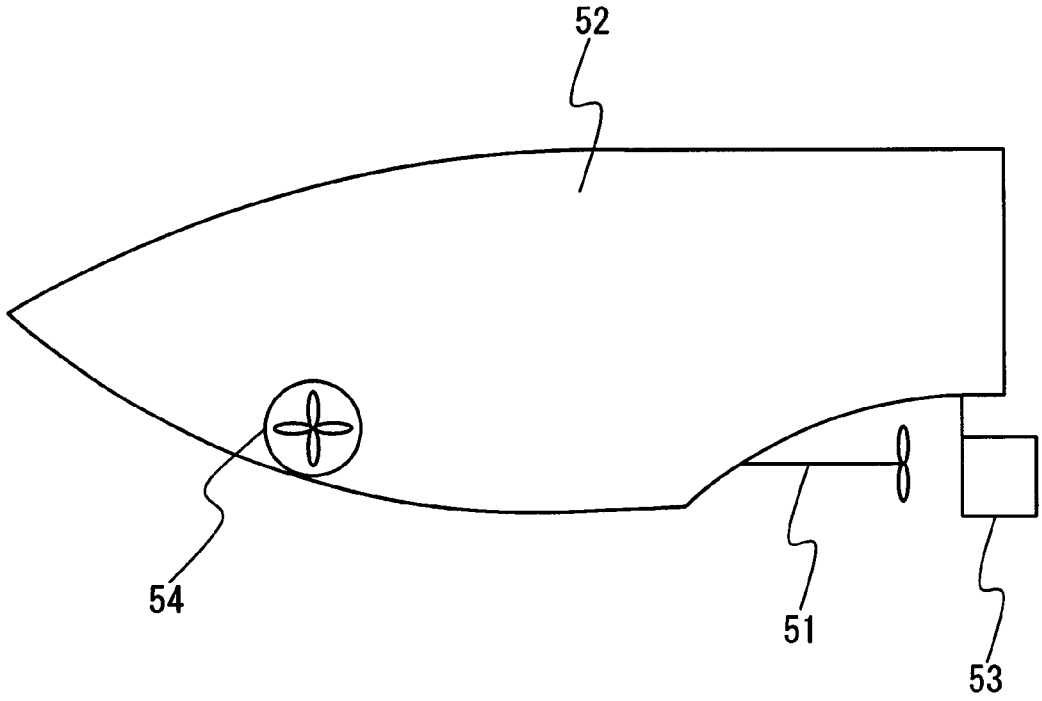
Fig. 1 PRIOR ART
FIG. 1 is a side view showing a conventional underwater running body.
Figure 2A:
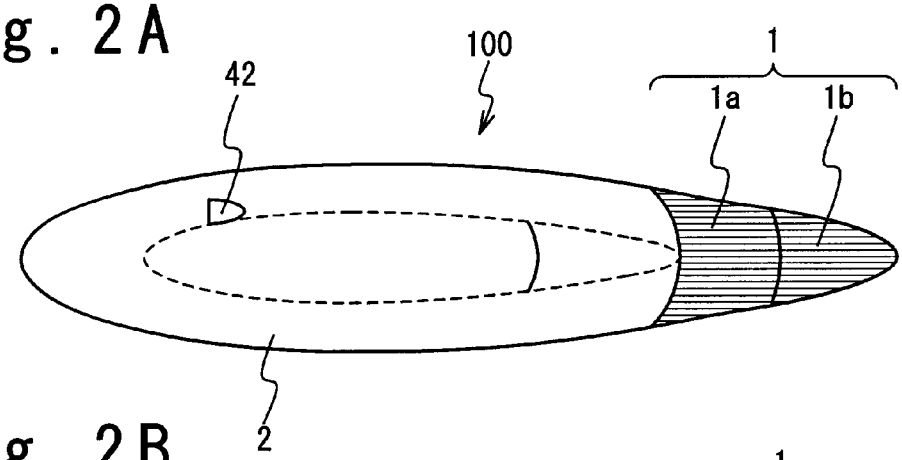
FIG. 2A is a side view diagrammatically showing an embodiment of an underwater propelling apparatus of the present invention.
Figure 2B:
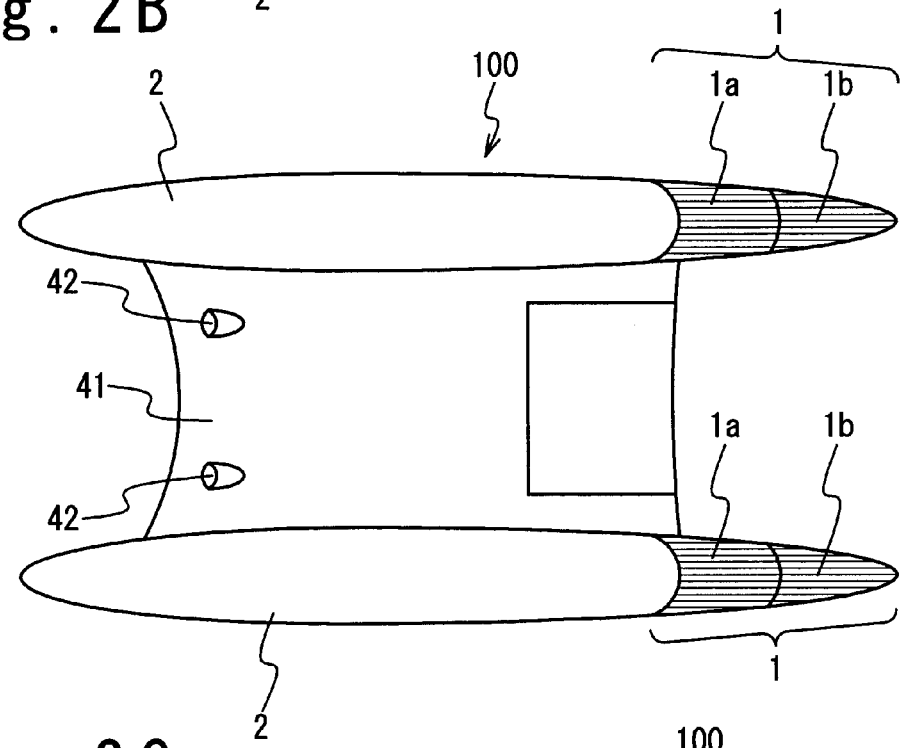
FIG. 2B is a plan view showing the underwater propelling apparatus.
Figure 2C:
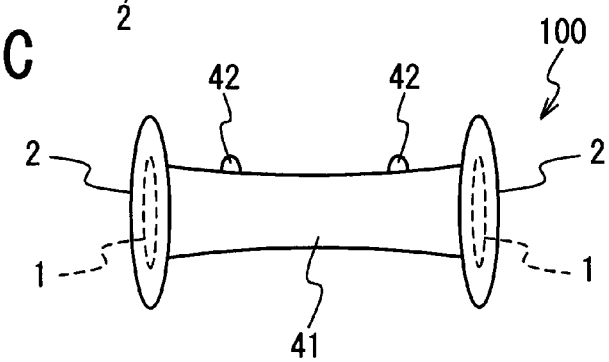
FIG. 2C is a front view showing the underwater propelling apparatus.
Figure 7:
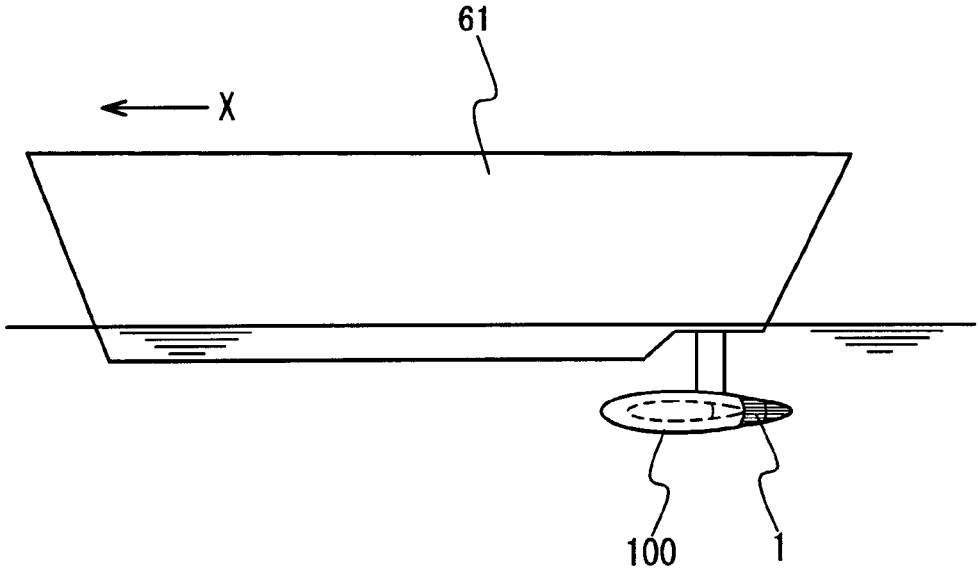
FIG. 7 is a side view diagrammatically showing a condition in which the embodiment of the underwater propelling apparatus of the present invention is applied to a fishing boat.
Figure 8:
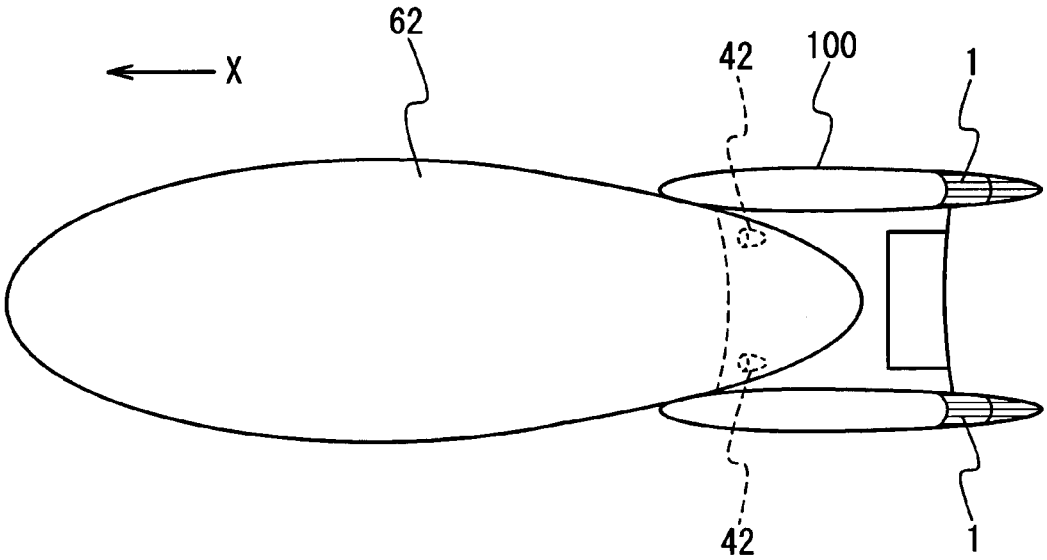
FIG. 8 is a plan view diagrammatically showing a condition in which the embodiment of the underwater propelling apparatus of the present invention is applied to a submarine boat.

FIG. 2A is a side view showing the underwater propelling apparatus in this embodiment, FIG. 2B is a plan view showing the underwater propelling apparatus, and FIG. 2C is a front view showing the underwater propelling apparatus. FIG. 7 is a side view diagrammatically showing the condition in which the underwater propelling apparatus in this embodiment is installed in a boat. FIG. 8 is a plan view diagrammatically showing the condition in which the underwater propelling apparatus in this embodiment is installed in a submarine boat.

By the way, although not shown, the underwater propelling apparatus in this embodiment can be used in a condition in which it is installed in another propelled body. In addition, it itself can function as an underwater vehicle (a submarine searching boat and the like) of a non-towed type.

As shown in FIGS. 2A to 2C, an underwater propelling apparatus 100 in this embodiment includes two underwater running units 2, 2 and a bed unit 41 through which the two underwater running units 2, 2 are linked to each other. The two underwater running units 2, 2 have the same configuration. Each of the underwater running units 2 and the bed unit 41 has an outer appearance formed by a smooth curve in order to reduce underwater resistance. The underwater running unit 2 is substantially ellipsoidal in shape such that a vertical side is longer when it is viewed from a front, and substantially ellipsoidal in shape such that a horizontal side is longer when it is viewed from a side and on a flat plane. The bed unit 41 is substantially ellipsoidal in shape such that a horizontal side is longer when it is viewed from a side, and it is substantially rectangular in shape in which a lateral side is longer when it is viewed from a front and on a flat plane. (The terms "vertical" and "horizontal" are used herein in the sense that the underwater propelling apparatus 100 is illustrated, for example, in drawing FIG. 2A, with the vertical direction extending in the up and down direction of the paper in the horizontal direction extending in the left to right direction of the paper. Thus these terms are used to indicate vertical and horizontal directions with respect to the underwater propelling apparatus 100 itself, and not with respect to absolute verticality or horizontality.)

As shown in FIG. 7, the underwater propelling apparatus 100 is installed in a fishing boat 61, and it propels the fishing boat 61 and carries out directional control or position keeping control of the fishing boat 61. Also, as shown in FIG. 8, the underwater propelling apparatus 100 is installed in a submarine boat 62, and it propels the submarine boat 62 and carries out directional control or position keeping control of the submarine boat 62.

In FIGS. 7 and 8, each arrow X indicates one direction in which each of the fishing boat 61 and the submarine boat 62 are propelled. The two underwater running units 2, 2 are placed in the bed unit 41 at positions separated from each other on a virtual line (not shown) substantially orthogonal to the direction X in which the fishing boat 61 or the submarine boat 62 is propelled.

As shown in FIG. 8, the two underwater running units 2, 2 are designed such that the separation distance is longer than a width dimension (a dimension in the upper and lower direction of FIG. 8) of the rear of the submarine boat 62. Although it is not shown in FIG. 7, the two underwater running units 2, 2 can be designed such that the separation length is longer than a width dimension (a dimension of a direction orthogonal to a paper surface) of the rear of the fishing boat 61.

As shown in FIGS. 7 and 8, the underwater propelling apparatus 100 is installed in the fishing boat 61 or the submarine boat 62 at the bed unit 41. As shown in FIG. 8, two lamps 42, 42 for illumination underwater are attached to the bed unit 41 of the underwater propelling apparatus 100 installed in the submarine boat 62.

The configuration of the underwater running unit 2 will be described below. As mentioned above, the configuration of the two underwater running units 2, 2 is the same. So, only one underwater running unit 2 is described, and the explanation of the other underwater running unit 2 is omitted.

As shown in FIGS. 2A, 2B, 3 and 4, two sets of wings (also, referred to as vibration wings) 1*a*, 1*b* are arranged in series in the tail of the underwater running unit 2. The two sets of the wings 1*a*, 1*b* arranged in series are jointly denoted as a wing (also referred to as a vibration wing) 1. Each of the two sets of the wings 1*a*, 1*b* is made of a metallic plate in order to satisfy strength and thinness requirements. The wing 1*b* positioned at the rear portion in the two sets of the wings 1*a*, 1*b* has a higher elastic modulus than that of the wing 1*a*. Rotation shafts 4, 5, which can be rotatably reciprocated so as to vibrate (swing) the vibration wings 1*a*, 1*b*, respectively, are fixed to a front edge of the vibration wings 1*a*, 1*b*.

A vibration wing controller 6, which has rotation shaft actuators 14, 15 (refer to FIG. 5) to perform a reciprocating rotation on the rotation shafts 4, 5, respectively, is placed inside the underwater running unit 2. Necessary electric power of the vibration wing controller 6 is supplied by a battery 16.

In this case, the battery 16 may be a charging type battery. It may be a non-contact charging type battery from the viewpoint of having water proof finish, and an electromagnetic induction battery can be used.

Moreover, the underwater propelling apparatus 100 includes an underwater wireless communication controller (not shown). It is then possible to communicate with the underwater propelling apparatus 100, which is a direct underwater vehicle, from the surface of the water, and possible to carry out simple communication between underwater devices.

Figure 3:
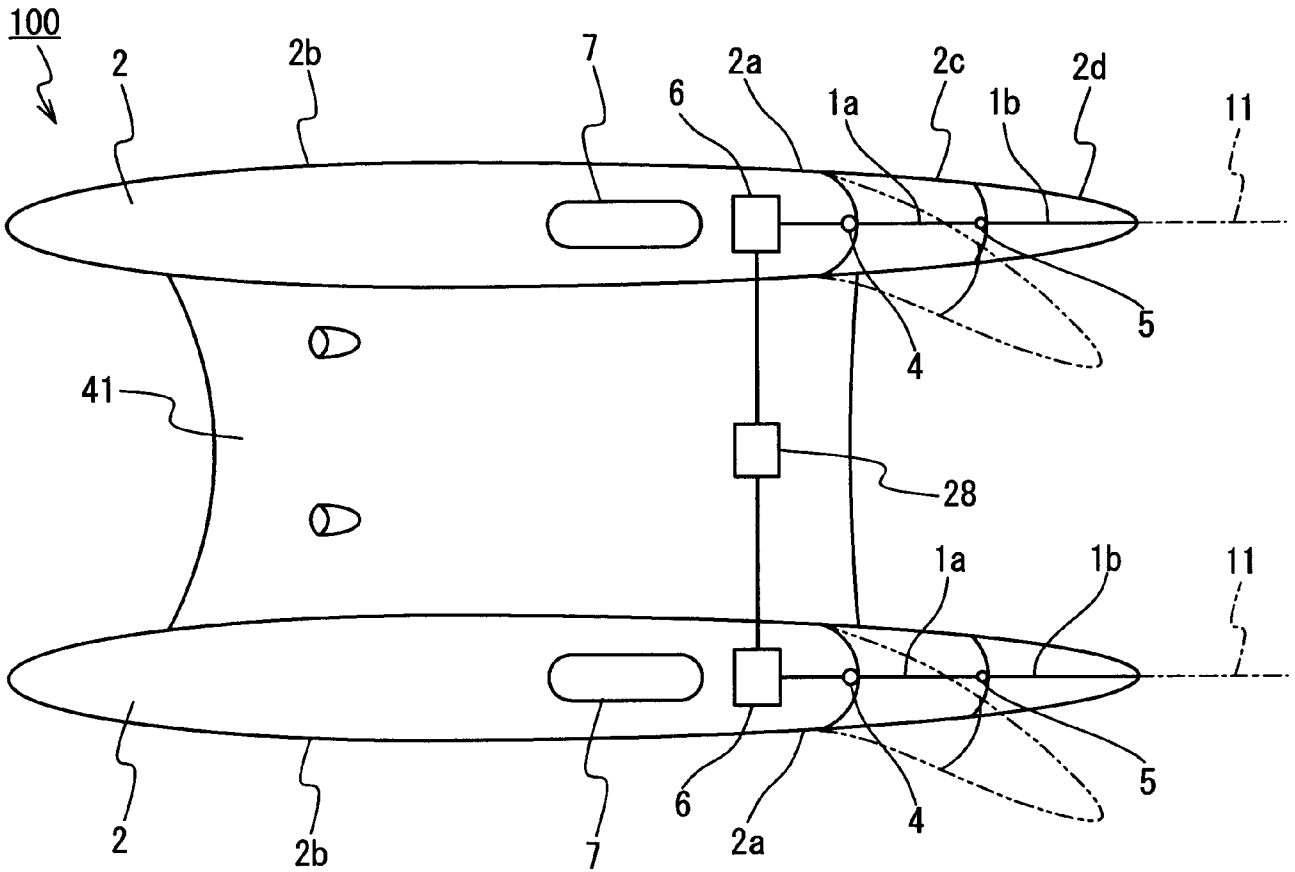
FIG. 3 is a plan view diagrammatically showing an inner configuration of the embodiment of the underwater propelling apparatus of the present invention.
Figure 4:
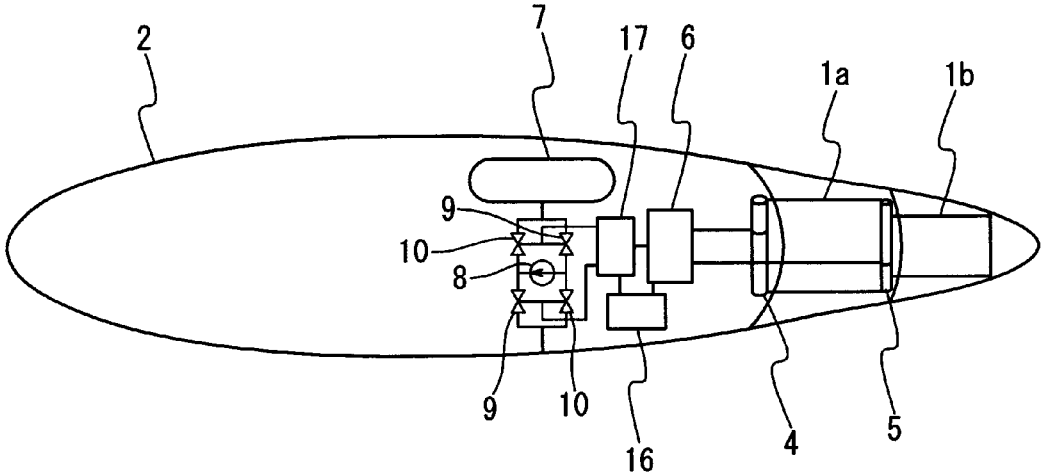
FIG. 4 is a side view diagrammatically showing the inner configuration of the embodiment of the underwater propelling apparatus of the present invention.

By the way, as shown in FIGS. 3, 4, the underwater propelling apparatus is configured such that the batteries 16 are placed in the respective two underwater running units 2, 2. However, instead of this configuration, a single battery 16 can be placed in the center of the bed unit 41.

Figure 5:
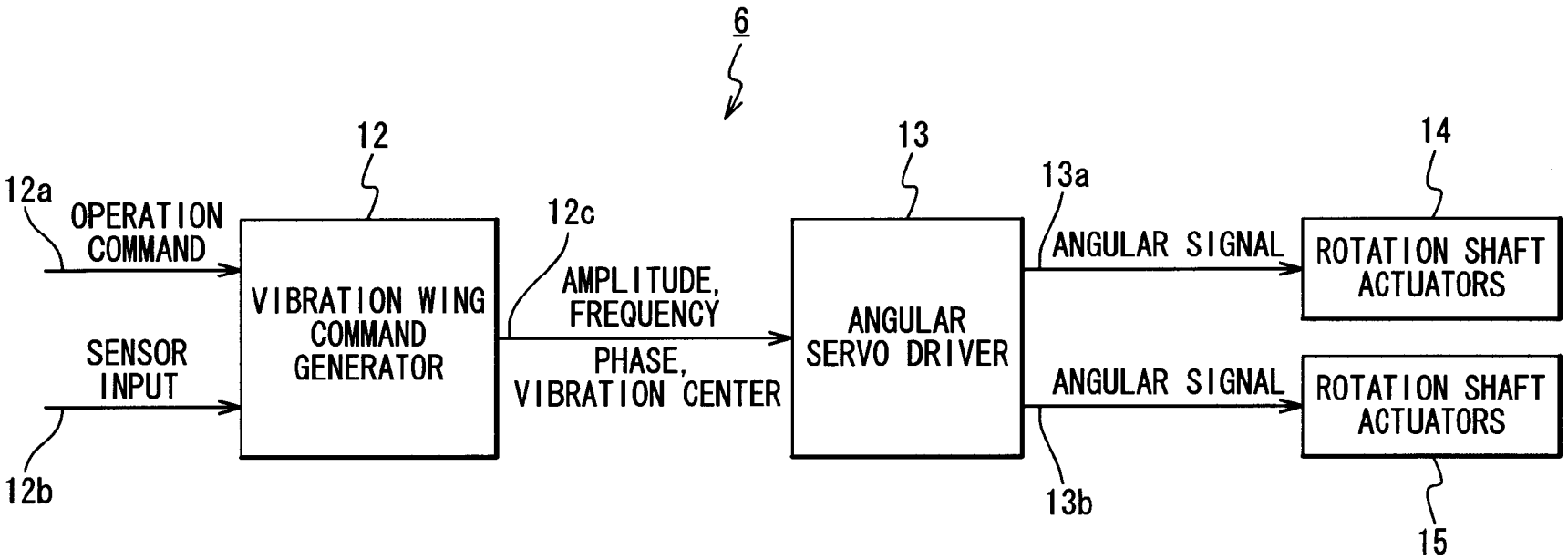
FIG. 5 is a block diagram diagrammatically showing a system for controlling two sets of wings connected in series in the embodiment of the underwater properlling apparatus of the present invention.

As shown in FIG. 5, the vibration wing controller 6 includes an angular servo driver 13 and a vibration wing command generator 12, in addition to the rotation shaft actuators 14, 15. The angular servo driver 13 actuates the respective rotation shaft actuators 14, 15 so that the rotation shafts 4, 5 of the vibration wings 1*a*, 1*b* are controlled respectively and jointly. The vibration wing command generator 12 sends a control signal 12*c* to the angular servo driver 13 so as to control the amplitudes, the frequencies, the phases and the vibration centers of the respective vibration wings 1*a*, 1*b*.

As shown in FIG. 3, a front portion of the underwater running unit 2 is covered with a rigid or flexible front envelope 2*b*. The portion corresponding to the vibration wing 1*a* of the underwater running unit 2 is covered with a flexible envelope 2*c* such as a coating material made of soft fiber reinforced plastic (FRP). This envelope 2*c* is connected to the front envelope 2*b* at a set portion 2*a*. Similarly, the portion corresponding to the vibration wing 1*b* of the underwater running unit 2 is covered with a flexible envelope 2*d* such as the coating material made of the soft fiber reinforced plastic (FRP).

Here, in each of the front envelope 2*b*, the envelope 2*c* and the envelope 2*d*, silicon resin and vinyl chloride can be simultaneously used from the viewpoint of their water proof property and the machining property instead of the above-mentioned materials.

In the underwater running unit 2, the envelopes 2*c*, 2*d* covering the vibration wings 1*a*, 1*b* are made of the flexible material so that the tail of the unit 2 can be smoothly curved in association with the actions of the respective vibration wings 1*a*, 1*b*. Here, the envelope 2*d* covering the vibration wing 1*b* is made of a material whose flexibility is higher than that of the envelope 2*c* covering the vibration wing 1*a*. This corresponds to the fact that the vibration wing 1*b* has an elastic modulus higher than that of the vibration wing 1*a*.

In the underwater running unit 2 in this embodiment, the vibration wing 1*b* on the tip of the unit 2 has the higher elastic modulus, and the envelope 2*d* has the higher flexibility. Thus, when the vibration wings 1*a*, 1*b* are actuated, the vibration wing 1*b* on the tip is flexed like a lash, and it is further sharply vibrated. This enables the thrust to be effectively obtained.

The underwater running unit 2 includes a tank 7 into and from which water can be filled and drained in order to control the floating/sinking state of the underwater propelling apparatus 100. As shown in FIG. 4, the underwater running unit 2 includes a piping system containing a pump 8 and switching valves 9, 10 and a buoyancy controller 17 for controlling the pump 8 and the respective switching valves 9, 10 to control the buoyancy of the tank 7 as a water filling/draining control mechanism of the tank 7.

By the way, in FIGS. 3, 4, the tanks 7, the water filling/draining control mechanisms and the buoyancy controllers 17 are configured so as to be placed in the two underwater running units 2, 2, respectively. However, instead of this configuration, the single tank 7, the water filling/draining control mechanism and the buoyancy controller 17 can be configured in the center of the bed unit 41.

Figure 6:
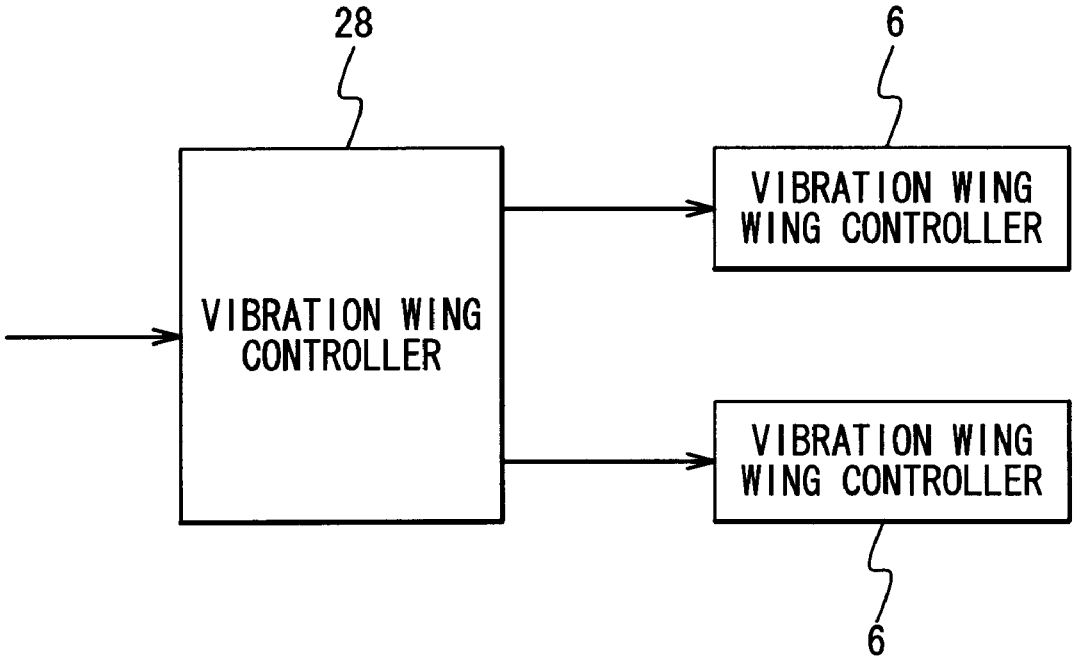
FIG. 6 is a block diagram diagrammatically showing a system for controlling a pair of right and left wings in the embodiment of the underwater propelling apparatus of the present invention.

As shown in FIGS. 3, 6, a vibration wing controller 28 is placed inside the bed unit 41. The vibration wing controller 28 is connected to the respective vibration wing controllers 6 of the two underwater running units 2, 2. The vibration wing controller 28 controls the vibration wings 1, 1 of the right and left two underwater running units 2, 2, in the right and left directions, respectively.

The vibration wing controller 28 outputs an operation command 12*a* and a sensor input 12*b* to the respective vibration wing command generators 12 of the two vibration wing controllers 6 (refer to FIG. 5).

The method of controlling the vibration wings 1, 1 of the right and left two underwater running units 2, 2 by using the vibration wing controller 28 will be described below.

(1) A thrust implying a manipulated variable is represented by a thrust applied to the center of gravity in the underwater propelling apparatus 100.

(2) The thrust is distributed to the right and left vibration wings 1, 1 so that the thrust explained in the item (1)

becomes the sum of the thrusts applied to the connection points to the body of the underwater propelling apparatus of the pair of right and left vibration wings 1, 1.

(3) When the steering operation is done, the difference between the respective thrusts of the right and left vibration wings 1, 1 is induced to thereby rotate the underwater propelling apparatus 100 in a desired direction.

The determination of the manipulated variable in the vibration wing command generator 12 for controlling the vibration wings 1*a*, 1*b* in the respective underwater running units 2 and the control in the buoyancy controller 17 after the distribution of the thrust to the vibration wings 1, 1 in the right and left two underwater running units 2, 2 as mentioned above will be described below.

(1) The thrust distributed to the underwater running unit 2 is decomposed into a horizontal component and a vertical component.

(2) The magnitude of the thrust in the horizontal component is controlled on the basis of the amplitudes of the reciprocating rotations of the rotation shafts 4, 5 and the values of the frequencies. Also, the orientation (advance or retreat) in the forward and backward direction of the thrust is controlled on the basis of the phase between the rotation shafts 4, 5. Then, the orientation of the thrust in the horizontal direction for the steering operation is controlled on the basis of the amount the vibration center of the vibration wings 1*a*, 1*b* is deviated from a central line 11 of this underwater running unit 2.

(3) The values of the amplitudes and the rotation speeds of the respective right and left vibration wings 1*a*, 1*a*, 1*b*, 1*b* are determined on the basis of the thrust in the horizontal directions to the respective right and left vibration wings 1, 1 which are distributed as mentioned above. Then, the respective vibration wing controllers 6 are controlled such that the angles around the respective rotation shafts 4, 4, 5, 5 cope with the above-mentioned amplitudes and the rotation speeds.

(4) As for the magnitude of the thrust in the vertical component, the buoyancy adjustment is carried out such that the buoyancy controller 17 controls the amount of the water within the tank 7 through the pump 8 and the respective switching valves 9, 10.

The vibration wing command generator 12 receives the operation command (the thrust, the turning round angle, the buoyancy and the like) 12*a* and the sensor input (the speed and the like) 12*b*, and outputs the amplitudes and the frequencies of the respective rotation shafts 4, 5 whose standard wave forms are sine waves, and the vibration center and the phase between the rotation shafts 4, 5, to define the motions of the vibration wings 1*a*, 1*b*.

Here, the vibration center implies the angle between the central line 11 of the underwater running unit 2 and the central position between the swung angles of the vibration wings 1*a*, 1*b*.

The angular servo driver 13 converts the outputs of the vibration wing command generators 12 into angular signals 13*a*, 13*b* of the respective vibration wings 1*a*, 1*b* to control the rotation shaft actuators 14, 15.

The control methods of the vibration wing controller 6, the vibration wing controller 28 and the buoyancy controller 17 will be described below.

(1) Study (Preparation) of Vibration Wing Command Generator 12

The speed of the underwater running unit 2 (the relative speed if there is current) and the optimal amplitude, the optimal frequency and the optimal phase difference of the vibration wing 1 for each thrust are determined by using the following procedure.

(a) The underwater running unit 2 (or the underwater propelling apparatus 100) is fixed in a water bath, and a strain gauge is placed in order to measure the thrust.

(b) The vibration wings 1*a*, 1*b* are operated so as to give a constant flow to the water bath and generate the thrust. Here, the flow speed of the flow is treated as the speed of the underwater running unit 2.

(c) The combination of the amplitudes, the frequencies and the phase differences of the vibration wings 1*a*, 1*b* when the total electric power consumption of the rotation shaft actuators 14, 15 becomes minimum under the condition that the particular thrust is generated is determined by using an optimization method such as the steepest descent method.

(d) Items (b), (c) are carried out for a combination of several kinds of speeds and thrusts, and the data are summed up in the format of a two-dimensional table composed of the speed and the thrust.

(2) Controlling Method of Vibration Wing Controller 6

After the study of the vibration wing command generator 12 is ended in accordance with the above-mentioned procedure, the vibration wing controller 6 controls the vibration wings 1*a*, 1*b* in accordance with the following procedure.

(a) The vibration wing command generator 12 receives a thrust from the operation command (a wireless command from an external portion) 12*a* and a speed from the sensor input 12*b* (reception from a speed meter attached to the underwater running unit 2), and interpolates the table studied in item (1) to output the amplitudes, frequencies and phase differences of the vibration wings 1*a*, 1*b* (refer to a symbol 12*c*).

(b) The vibration wing command generator 12 receives the turning round angle of the operation command 12*a*, and multiplies a coefficient to output as the vibration center (refer to symbol 12*c*). The coefficient is assumed to be the coefficient so that the maximum value of the vibration centers is normalized at the maximum value of the signals of the turning round angles.

(c) When the amplitude (maximum angle) implying the output (refer to the symbol 12*c*) from the vibration wing command generator 12 is assumed to be A, the frequency (the number of the angular vibrations) implying that is assumed to be ω, the phase implying that is assumed to be α, the vibration center implying that is assumed to be K and the time is assumed to be t, the angular servo driver 13 outputs the angular signals 13*a*, 13*b* of the rotation shaft actuators 14, 15 by using the following equations:

$$\text{Angular Signal of Rotation Shaft Actuator } \mathbf{14} = A\sin(\omega t)+K$$

$$\text{Angular Signal of Rotation Shaft Actuator } \mathbf{15} = A\sin(\omega t+\alpha)+K$$

(d) The rotation shaft actuators 14, 15 vibrate the wings 1*a*, 1*b* in accordance with the angular signals 13*a*, 13*b* determined in item (c), respectively.

(3) Controlling Method of Vibration Wing Controller 18

(a) The vibration wing controller 28 distributes the operation command (a force and a moment which are applied to the underwater propelling apparatus) of the underwater propelling apparatus 100 to the right and left vibration wings 1, 1 by using a non-linear planning method under the condition that the magnitudes and the directions of the thrusts which can be outputted from the respective vibration wings 1, 1 are restricted.

(b) The swinging patterns for generating the forces distributed to the respective vibration wings 1, 1 in the item (a) are determined from the data prepared in the item (1).

(c) The swinging patterns determined in the item (b) are updated for each reciprocation to control the vibration wings 1*a*, 1*a*, 1*b*, 1*b*.

(4) Controlling Method of Buoyancy Controller 17

The buoyancy controller 17 adjusts the buoyancy in accordance with the following procedure.

(a) The buoyancy of the operation command is decomposed into the magnitude and the direction of the buoyancy.

(b) Based on the direction of the buoyancy, at a time of a floating action, a draining valve 9 is opened, and a feeding value 10 is closed. At a time of a sinking action, the feeding value 10 is opened, and the draining valve 9 is closed.

(c) Based on the magnitude of the buoyancy, the output of the feeding/draining pump 8 is adjusted.

(d) When a flow amount of an inlet of a buoy becomes 0 (when it becomes full or empty), the feeding/draining pump 8 is stopped.

In the underwater running unit 2 having the above-mentioned vibration wing, it is possible to carry out three-dimensional control of the propelling, the rotating and the floating/sinking. That is, the plurality of wings 1*a*, 1*b*, which are vibrated by the reciprocating rotations of the rotation shafts 4, 5 fixed to the front edge, are arranged in series. Thus, the joint control of the amplitudes, the frequencies, the vibration centers and the phases between the respective wings 1*a*, 1*b* enables the plurality of sets of wings 1*a*, 1*b* to be smoothly swung, such as the tail fin of a fish, as a whole, and the necessary thrust is generated, and the necessary steering operation is performed. Hence, there is no risk of the enfolding of the conventional screw propeller 51, and it is superior in silence to the screw propeller 51.

By the way, in the underwater propelling apparatus 100 of this embodiment, the number of the vibration wings 1*a*, 1*b* is assumed to be 2 in one underwater running unit 2. However, 3 or more vibration wings is naturally allowable.

Also, in the underwater propelling apparatus 100, the rotation shafts 4, 5 are placed in the longitudinal (vertical) direction. However, instead of that configuration, if the rotation shafts 4, 5 are placed in the lateral (horizontal) direction, the plurality of sets of wings 1*a*, 1*b* are actuated such as a submarine rudder of the submarine boat or pectoral fins on both sides of a fish. Consequently, it is possible to change a submarine depth.

Moreover, the underwater propelling apparatus 100 in this embodiment includes the tank 7 in which the water filling/draining control can be attained. Thus, the tank 7 is used to adjust the buoyancy. Hence, it is possible to smoothly carry out floating/sinking control of the underwater propelling apparatus 100.

Moreover, according to the underwater propelling apparatus 100 in this embodiment, the two underwater running units 2 having the above-mentioned configuration are horizontally arranged parallel to each other. In other words, the two vibration wings 1, 1 are placed at positions separated from each other on a virtual line (a virtually straight line extending in the upper and lower directions in FIG. 8, although they are not shown) substantially orthogonal to direction X (shown on the left side in FIG. 8) in which the fishing boat 61 or the submarine boat 62 (the propelled body) is propelled.

For this reason, stable propelling, steering, directional control, and position maintenance functions can be attained as compared with the case of a single underwater running unit 2. Thus, the bed unit 41 is stable. In the case of the single underwater running unit 2, when the vibration wings 1*a*, 1*b* are actuated, the underwater propelling apparatus may be rotated to thereby disable the obtainment of the stableness. In particular, if the underwater propelling apparatus 100 in this embodiment is used for the fishing boat 61, the stableness can be used such that the position keeping function and the silence property become effective.

As mentioned above with reference to FIG. 8, the two vibration wings 1, 1 are placed so as to be separated at an approximate separation distance longer than the width dimension in the rear of the submarine boat 62 (the propelled body) on the virtual line. Thus, the effect of the stableness becomes greater.

The effect of stableness obtained by placing the plurality of underwater running units 2, 2 parallel to each other can be provided even if each of the underwater running units 2 has only one vibration wing, instead of the configuration in which each has the two sets of the vibration wings 1*a*, 1*b* placed in series.

Also, the installation of the plurality of underwater running units 2, 2 improves the thrust.

Moreover, in the underwater propelling apparatus 100 of this embodiment, when the vibration wings 1*a*, 1*b* are actuated, the vibration wing 1*b* on the tip side has a higher elastic modulus, and the envelope 2*d* has a higher flexibility than that of the envelope 2*c*. Thus, the vibration wing 1*b* on the tip side is flexed like a lash, and it is further sharply vibrated. This enables the thrust to be effectively obtained.

As mentioned above, according to the underwater propelling apparatus of the present invention, it is possible to attain the directional controlling and positional keeping functions which are further stable.

What is claimed is:

1. An underwater propelling apparatus, comprising:

a body having a rear side and a forward side; and a plurality of vibrating units placed in parallel to each other on a rear side of said body;

wherein each of said plurality of vibrating units is capable of vibrating repeatedly and reciprocally to produce thrust;

wherein each of said plurality of vibrating units comprises elastic vibrators placed in series; and wherein one of said vibrators positioned rearwardly of another of said vibrators has a higher elastic modulus than the other of said vibrators.

2. The underwater propelling apparatus of claim 1, comprising a non-towed submarine boat having said body connected thereto.

3. The underwater propelling apparatus of claim 2, wherein each of said vibrators of each of said plurality of vibrating units is independently controllable.

4. The underwater propelling apparatus of claim 1, wherein each of said vibrators of each of said plurality of vibrating units is independently controllable.

5. A propelled body comprising said underwater propelling apparatus of claim 4 so as to be capable of being propelled by said underwater propelling apparatus, wherein:

said propelled body has a direction in which said propelled body is to be propelled; and said plurality of vibrating units of said underwater propelling apparatus are separated from each other in a direction substantially orthogonal to the direction in which said propelled body is to be propelled.

6. A propelled body comprising said underwater propelling apparatus of claim 1 so as to be capable of being propelled by said underwater propelling apparatus, wherein:

said propelled body has a direction in which said propelled body is to be propelled; and said plurality of vibrating units of said underwater propelling apparatus are separated from each other in a direction substantially orthogonal to the direction in which said propelled body is to be propelled.

7. The underwater propelling apparatus of claim 1, wherein:

said underwater propelling apparatus has a direction in which said underwater propelling apparatus is to be propelled; and said plurality of vibrating units of said underwater propelling apparatus are separated from each other in a direction substantially orthogonal to the direction in which said underwater propelling apparatus is to be propelled.

8. The underwater propelling apparatus of claim 1, and further comprising:

a tank into and from which water can be filled and drained to control a floating and sinking state of said body; and a water filling and draining control unit which controls operations of filling and draining water into and from said tank.

9. The underwater propelling apparatus of claim 1, wherein:

said body comprises a plurality of underwater running units and a bed unit liking said plurality of underwater running units;

said plurality of vibrating units are provided in respective rear portions of said plurality of underwater running units; and each of said plurality of underwater running units and said bed unit has an outer appearance formed by a smooth curve to reduce underwater resistance.

10. The underwater propelling apparatus of claim 9, wherein each of said plurality of underwater running units is substantially ellipsoidal in shape such that a vertical side of each of said plurality of underwater running units is longer as viewed from a front of each of said plurality of underwater running units and substantially ellipsoidal in shape such that a horizontal side of each of said plurality of underwater running units is longer as viewed from a side of each of said plurality of underwater running units and on a flat plane of each of said plurality of underwater running units.

11. The underwater propelling apparatus of claim 9, wherein said bed unit is substantially ellipsoidal in shape such that a horizontal side of said bed unit is longer as viewed from a side of said bed unit and substantially rectangular in shape such that a horizontal side of said bed unit is longer as viewed from a front of said bed unit and on a flat plane of said bed unit.

12. The underwater propelling apparatus of claim 9, comprising a submarine boat having a rear width dimension, wherein said plurality of underwater running units are separated by a separation distance longer than the width dimension of said submarine boat.

13. An underwater propelling apparatus, comprising:

a body having a rear side and a forward side;

a first vibrating unit located on the rear side of said body comprising a first vibrator that is vibrated by reciprocating rotation of a first rotation shaft and a second vibrator that is vibrated by reciprocating rotation of a second rotation shaft, said first vibrator and said second vibrator being arranged in series;

a second vibrating unit located on the rear side of said body and parallel with said first vibrating unit in a horizontal direction and comprising a third vibrator that is vibrated by reciprocating rotation of a third rotation shaft and a fourth vibrator that is vibrated by reciprocating rotation of a fourth rotation shaft, said third vibrator and said fourth vibrator being arranged in series;

first to fourth actuators to rotate said first to fourth rotation shafts, respectively;

a vibrator command generator to output a control signal to set respective amplitudes, frequencies and vibration centers of said first to fourth vibrators associated with the reciprocating rotation of said first to fourth rotation shafts and phases between said first to fourth vibrators to control said first to fourth rotation shafts jointly and respectively; and an angular servo driver to generate signals to control said first to fourth actuators, respectively, on the basis of a control signal;

wherein each of said first to fourth vibrators is elastic, said second vibrator, positioned rearwardly of said first vibrator with respect to said body, has a higher elastic modulus than said first vibrator, and said fourth vibrator, positioned rearwardly of said third vibrator with respect to said body, has a higher elastic modulus than said third vibrator.

14. The underwater propelling apparatus of claim 13, wherein said first to fourth rotation shafts extend horizontally.

15. The underwater propelling apparatus of claim 13, wherein said first to fourth rotation shafts extend horizontally such that said first and second vibrating units can control submarine depth of said underwater propelling apparatus.

* * * * *